US005539943A

United States Patent [19]

Romano

[11] Patent Number: 5,539,943

[45] Date of Patent: Jul. 30, 1996

[54] APPARATUS AND METHOD FOR PERCUSSION OF FLUIDIZED SUPPORT SURFACE

[75] Inventor: James J. Romano, Charleston, S.C.

[73] Assignee: SSI Medical Services, Inc., Charleston, S.C.

[21] Appl. No.: 207,430

[22] Filed: Mar. 8, 1994

[51] Int. Cl.[6] ..... A61G 7/04

[52] U.S. Cl. ..... 5/453; 5/912; 5/933

[58] Field of Search ..... 5/450, 453, 912, 5/469, 933, 915, 449

[56] References Cited

U.S. PATENT DOCUMENTS

| | | | |
|---|---|---|---|
| 3,428,973 | 2/1969 | Hargest et al. . | |
| 3,866,606 | 2/1975 | Hargest . | |
| 3,955,563 | 5/1976 | Maione . | |
| 4,481,686 | 11/1984 | Lacoste . | |
| 4,483,029 | 11/1984 | Paul . | |
| 4,508,107 | 4/1986 | Strom et al. . | |
| 4,564,965 | 1/1986 | Goodwin . | |
| 4,599,755 | 7/1986 | Tominaga | 5/912 |
| 4,609,854 | 9/1986 | Yamamoto et al. . | |
| 4,637,083 | 1/1987 | Goodwin . | |
| 4,684,486 | 8/1987 | Ricchio | 5/453 |
| 4,723,328 | 2/1988 | Kato . | |
| 4,753,225 | 6/1988 | Vogel . | |
| 4,794,659 | 1/1989 | Kurita | 5/912 |
| 4,837,880 | 6/1989 | Coffman | 5/453 |
| 4,914,760 | 4/1990 | Hargest et al. . | |
| 4,942,635 | 7/1990 | Hargest et al. . | |
| 4,967,431 | 11/1990 | Hargest et al. . | |
| 5,008,965 | 4/1991 | Vrzalik . | |
| 5,029,352 | 7/1991 | Hargest et al. . | |
| 5,036,559 | 8/1991 | Hargest . | |
| 5,074,286 | 12/1991 | Gillaspie | 5/453 |

FOREIGN PATENT DOCUMENTS

| | | |
|---|---|---|
| 0317009 | 5/1989 | European Pat. Off. . |
| 0332242 | 9/1989 | European Pat. Off. . |
| 2546403 | 5/1984 | France . |
| 58-94852 | 6/1983 | Japan . |
| 61-22860 | 1/1986 | Japan . |
| 61-103122 | 7/1986 | Japan . |
| WO9000381 | 1/1990 | WIPO . |

OTHER PUBLICATIONS

Kunii et al, Fluidization Engineering, pp. 74–75, 82–89, (1969) New York, John Wiley & Sons, Inc.

*Primary Examiner*—Flemming Saether
*Attorney, Agent, or Firm*—Dority & Manning

[57] ABSTRACT

A fluidized patient support having a tank with side walls and a bottom holds a mass of fluidizable beads and includes a diffuser board disposed near the tank bottom to define a plenum which receives air flow from a blower. The fluidized patient support is provided with a percussive patient support surface by operative components that superimpose percussive fluidization in at least one preselected portion of the support surface formed when the beads are fluidized. The superimposed percussive fluidization results in large slugs of air reaching the patient support surface. Upon reaching the patient support surface, these slugs of higher pressure air percuss the body of the patient that is supported where such large slugs breach the surface.

17 Claims, 5 Drawing Sheets

APPARATUS AND METHOD FOR PERCUSSION OF FLUIDIZED SUPPORT SURFACE

BACKGROUND OF THE INVENTION

The present invention relates to fluidized patient support surfaces and more particularly to fluidized patient support surfaces with the capability of changing the fluidization characteristics of the patient support surface.

Fluidized patient support surfaces have been used for treating patients confined to beds for long periods of time. Many examples are found in the patent literature, including Hargest et al U.S. Pat. Nos. 3,428,973; Hargest U.S. Pat. No. 3,866,606; Lacoste U.S. Pat. No. 4,481,686; Paul U.S. Pat. No. 4,483,029; Goodwin U.S. Pat. No. 4,564,965; Goodwin U.S. Pat. No. 4,637,083; Hargest et al U.S. Pat. No. 4,914,760; Hargest et al U.S. Pat. No. 4,942,635; Hargest et al U.S. Pat. No. 4,967,431; Vrzalik U.S. Pat. No. 5,008,965; Hargest et al U.S. Pat. No. 5,029,352; and Hargest U.S. Pat. No. 5,036,559; all of which except the patent to Vrzalik being hereby incorporated herein by this reference. Intermittently turning the fluidization of the entire support surface on and off is disclosed in Hargest U.S. Pat. No. 3,866,606. Sequentially turning the fluidization on and off under successive discrete portions of the fluidized patient support system is disclosed in Goodwin U.S. Pat. No. 4,637,083, which subjects the patient to fluidization beneath different portions of the patient's body at any given moment in time.

It is known that the application of undulating or vibratory action to the area of the body adjacent to the thoracic cavity, can induce postural draining or coughing up of sputum, thereby reducing the amount of mucous that lines the inner walls of the alveoli. Therapeutic percussors and vibrators have been used to stimulate expectoration of mucous from the lungs. Examples of various pneumatic and mechanical types of percussors would include those disclosed in Strom et al U.S. Pat. No. 4,508,107 and Maione U.S. Pat. No. 3,955,563. Heretofore, such external mechanical or pneumatic types of percussors would be needed to provide percussive chest therapy to induce mucociliary clearance for a patient resting in an air fluidized bed. The external percussor would be applied directly to the patient's upper torso to loosen the mucous.

OBJECTS AND SUMMARY OF THE INVENTION

It is a principal object of the present invention to create a fluidized patient support surface that provides a massaging action to the patient supported on such surface.

It is another principal object of the present invention to create a fluidized patient support surface that provides a percussive action to the patient supported on such surface.

It is a further principal object of the present invention to create a fluidized patient support surface that provides a percussive action to selected regions of the body of the patient supported on such surface.

Yet another principal object of the present invention to provide an air fluidized patient support system having an enhanced pulsation mode for causing a stimulating massaging effect to the patient resting thereon.

Still a further principal object of the present invention is to provide a multi-modal, air fluidized patient support system wherein at least one mode thereof includes an improved percussion mode for enhancing the massaging effect thereof.

An additional principal object of the present invention is to provide a vibratory patient support system to aid in the treatment of lung disorders.

A further principal object of the present invention is to combine the benefits of air fluidized therapy with therapeutic vibratory means for treating lung disorders.

Yet another principal object of this invention is to provide a multi-mode air fluidized patient support system having a vibrational therapy capability in any one of its operational modes.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the apparatus and method of the present invention can be summarized as follows.

A fluidized patient support having a tank with side walls and a bottom holds a mass of fluidizable beads and includes a diffuser board disposed near the tank bottom to define a plenum which receives air flow from a blower. In accordance with the present invention, the fluidized patient support is provided with a percussive patient support surface by providing a means for superimposing percussive fluidization in at least one preselected portion of the support surface formed when the beads are fluidized. The superimposed percussive fluidization results in large slugs of air reaching the patient support surface. Upon reaching the patient support surface, these slugs of higher pressure air percuss the body of the patient that is supported where such large slugs breach the surface.

As embodied herein, the percussive fluidization superimposing means can include a first portion of the plenum that is separated from the rest of the plenum and provided with a means for introducing at least 25% more air flow into the mass of beads disposed above that first portion of the plenum. This can be accomplished by reducing the thickness of a first portion of the diffuser board that is disposed above the first portion of the plenum or increasing the local porosity of this first portion of the plenum board. In this way, at least 25% more air flow can be provided through the first portion of the diffuser board than the same pressure drop across the diffuser board produces in the other portions of diffuser board at rates of air flow producing normal fluidization above the other portions of the diffuser board.

A first alternative embodiment of the percussive fluidization superimposing means can include a means for augmenting the flow of air into the first portion of the plenum to introduce an extra charge of gas from the blower into the first portion of the plenum. This embodiment of the percussive fluidization superimposing means can include a separate variable flow valve that is configured and disposed for controlling the flow of air through a plenum inlet pipe. The separate variable flow valve can be controlled by a controller such as a microprocessor or other controller to regulate the flow of air through that valve's inlet pipe leading to a chamber of the plenum.

A second alternative embodiment of the percussive fluidization superimposing means can include a means for intermittently connecting the outlet of the blower into communication with the first portion of the plenum to introduce an extra charge of gas from the blower into the first portion of the plenum. The intermittent outlet connecting means can include a shuttle valve disposed in communication with the first portion of plenum and with the outlet of the blower via a pulsation pipe, which is connected in communication with a second branch of the blower outlet manifold pipe. A first separate variable flow valve can be configured and disposed for controlling the flow of air through the pulsation pipe and into the first portion of the plenum. The variable flow valve can be automatically controlled by a controller such as a microprocessor or other control means. This second alternative embodiment of the percussive fluidization superimposing means also can include a second separate variable flow valve that is configured and disposed for controlling the flow of air through the plenum inlet pipe serving the first portion of the plenum. This second separate variable flow valve can be controlled by a controller such as a microprocessor or other controller to regulate the flow of air through that inlet pipe.

A third alternative embodiment of the percussive fluidization superimposing means can include at least a first opening disposed through a portion of the diffuser board. A feedthrough opening can be provided through a portion of the bottom of the tank forming the plenum. The feedthrough opening is desirably in registry with the first opening of the diffuser board. This third alternative embodiment also can include a conduit disposed through the feedthrough opening of the plenum and through the first opening of the diffuser board. Alternatively, the conduit could originate within the plenum instead of entering through the feedthrough opening. The conduit terminates in at least two oppositely disposed exit openings in a "T" fixture.

In a fourth alternative embodiment of the percussive fluidization superimposing means, a first opening is provided in the side of the tank near the diffuser board, and the conduit can enter the tank through the first opening and terminate in a bubblecap that allows the air to escape but prevents the fluidizable material from falling into the conduit and clogging same.

In yet a fifth alternative embodiment of the percussive fluidization superimposing means, a conduit can terminate in an antenna-like structure having a plurality of branches interconnecting with a blind main "T" fixture. The conduit can be connected in communication with the blower. Each branch of the blind main "T" fixture has a plurality of exit openings formed in the upper surface of each branch. However, in order to shield the exit openings from being clogged with the fluidizable material, the exit openings desirably could be formed in the bottom surface of each branch or in one or both of the opposite side surfaces of each branch.

In yet a sixth alternative embodiment of the percussive fluidization superimposing means, at least one length of porous tubing can be disposed to extend from one side wall to the opposite side wall near the diffuser board disposed above the bottom of the tank. The number of tubes is determined by the extent of the desired region of percussion at the surface of the fluidizable mass of material. Each porous tube emanates from a manifold which can be connected to a feeder pipe that extends through an opening in the side wall of the tank. The feeder pipe desirably is integral with the conduit which is connected in communication with the blower.

In each of the alternative embodiments, a shuttle valve as described above also can be interposed between the outlet of the blower and the conduit to provide either continuous or intermittent, as desired, air flow into the beads in the local region above the structure introducing auxiliary air into the mass of fluidizable material. Moreover, the blower and the shuttle valve can be controlled by a controller as described above.

The accompanying drawings, which are incorporated in and constitute a part of this specification, illustrate more than one embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are applied to the same features throughout the written description and drawings.

In accordance with the present invention, a fluidized patient support includes an apparatus for percussion of its fluidized patient support surface. A preferred embodiment of a fluidized patient support with a percussive patient support surface is schematically shown in FIG. 1 and is represented generally by the numeral 20.

Figure 1:
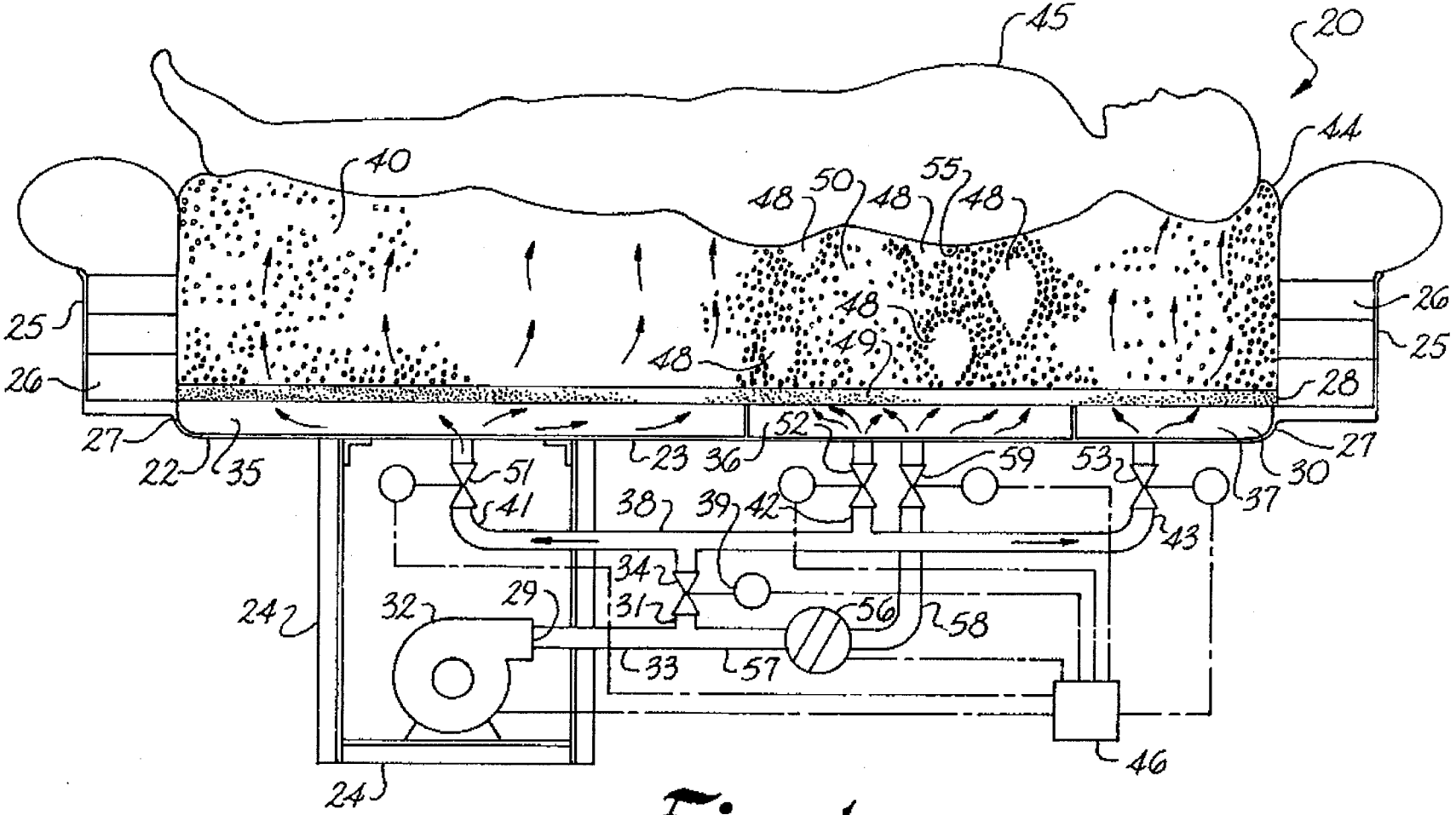
FIG. 1 is a schematic representation of a cross-sectional view of a preferred embodiment of the present invention.

A fluidized patient support such as an air fluidized bed is schematically shown in FIG. 1 and includes a tank 22. As schematically shown in FIG. 1, tank 22 may be supported by a frame 24. The tank has a bottom 23 and sides 25 which extend generally upwardly from the bottom 23. The sides 25 define an open top at the free end of the sides. Inflatable walls 26 may be disposed inside the sides of the tank. A diffuser board 28 is disposed near the tank bottom to define a plenum 30 between tank bottom 23, diffuser board 28, and a lower portion 27 of the tank sides disposed near tank bottom 23. Diffuser board 28 desirably is formed of an air permeable material that is rigid enough when reinforced, to be able to support a considerable weight of fluidizable material, which is generally indicated by the numeral 40.

An air blower 32 can serve as a means for providing a constant flow of air to the plenum. Air blower 32 can be carried by the frame 24 of the fluidized bed and has an outlet 29 that is connected in communication with plenum 30 to supply pressurized air to plenum 30. As shown in FIG. 1, the blower outlet 29 is connected with a blower outlet manifold pipe 33, which has a first branch 31 that is fitted with a variable flow valve 34. The plenum can be divided into more than one chamber. As schematically shown in FIG. 1, plenum 30 is divided into three separate chambers 35, 36, 37 such that air entering one chamber cannot pass into one of the other two chambers. The outlet of the variable flow valve 34 is connected into communication with a plenum supply manifold 38, which branches off into a first inlet pipe 41, a second inlet pipe 42, and a third inlet pipe 43. Each of the first, second and third inlet pipes 41, 42, 43, is connected respectively in communication with first chamber 35, second chamber 36, and third chamber 37, of plenum 30.

As shown in FIGS. 1, 3, 4, and 7, a mass of fluidizable material 40, such as glass or ceramic beads for example, is disposed in tank 22 and carried by diffuser board 28 to be fluidized by air supplied from blower 32 to plenum 30. A cover sheet 44 extends between the inflatable walls 26. The cover sheet is formed of an air permeable textile material such as fine nylon mesh that is impermeable to the passage of the fluidizable material 40. The cover sheet 44 separates the patient's body 45 from the fluidizable material 40 and helps retain the fluidizable material inside the tank.

As schematically shown in FIG. 1, operation of blower 32 provides a flow of air that can be regulated by variable flow valve 34. Variable flow valve 34 can be automatically controlled by a controller 46 such as a microprocessor or other control means, and this is schematically indicated in FIG. 1 by the chain-dashed line extending between controller 46 and the motor (schematically indicated by the circle on the stem) 39 of variable flow valve 34. Controller 46 also can regulate the speed of blower 32 to provide another degree of control over the flow of air into plenum 30, and this is schematically indicated in FIG. 1 by the chain-dashed line extending between controller 46 and blower 32.

As schematically indicated by the curved arrows in FIG. 1, the air flows into the plenum manifold 38 and thence through each of the first inlet pipe 41, second inlet pipe 42, and third inlet pipe 43. Upon exiting each of the inlet pipes 41–43, the flow of air enters the respective plenum chamber 35–37 served by the particular inlet pipe. Upon entering each respective plenum chamber, the flow of air penetrates through the portion of the diffuser board 28 that forms the top of that particular plenum chamber and rises through the mass of fluidizable material 40 to fluidize same. The curved arrows disposed in the region between cover sheet 44 and diffuser board 28 and containing the mass of fluidizable material 40, schematically indicate fluidization of the fluidizable material. As known in the art, when the correct amount of air flow is provided, the mass of fluidizable material 40 becomes fluidized sufficiently to support the body 45 of the patient above a fluidized patient support surface 55 defined by the contour of the cover sheet 44, which rests atop and is carried by the surface of the fluidized material 40.

It is believed that for an essentially uniform gas distributor such as a typical diffuser board, the pressure drop of the gas passing through the fluidizable material 40 increases linearly with increasing gas velocity through the fluidizable material, until a sufficiently high gas velocity has been attained for fluidization of the material 40 to occur. At this gas velocity at which fluidization begins to occur, the so-called fluidization threshold gas velocity, a further increase in gas velocity results in a sudden step reduction in pressure drop. Whereupon additional increases in gas velocity during fluidization result in an essentially constant pressure drop until yet a further increase in gas velocity begins to result in the slugging phenomenon. The present invention takes advantage of this slugging phenomenon to produce a percussive effect at the surface of the air fluidized mass of material.

In further accordance with the present invention, a means can be provided for superimposing percussive fluidization in at least one preselected portion of the support surface formed when the beads are fluidized. As shown schematically in FIGS. 1, 3, 4 and 7, the superimposed percussive fluidization results in large slugs 48 of air reaching the patient support surface. This phenomenon differs from that produced by the method disclosed for example in U.S. Pat. Nos. 3,866,606; 4,483,029; and 4,637,083; in which uniform fluidization is intermittently turned on and off. Upon reaching the patient support surface 55, these slugs 48 of higher pressure air percuss the body 45 of the patient that is supported where such large slugs 48 breach the surface 55.

As embodied herein, the percussive fluidization superimposing means can include a first portion of the plenum that is separated from the rest of the plenum. In the embodiment schematically shown in FIG. 1 for example, this first portion of plenum 30 corresponds to second plenum chamber 36, which desirably is configured and disposed to be located beneath the back/chest of the patient 45 supported by the patient support surface 55. In other embodiments, the first portion of the plenum might be designed to be located beneath a different portion of the patient's anatomy.

The percussive fluidization superimposing means can further include a first portion 49 of diffuser board 28. This first portion 49 of diffuser board 28 desirably forms the top of the corresponding first portion of plenum 30, which in the illustrated embodiment is second chamber 36. First portion 49 of diffuser board 28 desirably can be formed with an average porosity that is higher than the average porosity of the rest of diffuser board. Alternatively, first portion 49 of diffuser board 28 can be formed with an average thickness that is less than the average thickness of the rest of the diffuser board. In both cases, first portion 49 of diffuser board 28 provides relatively less resistance to the flow of air therethrough than does the rest of the diffuser board. Desirably, the higher porosity and/or reduced thickness in first portion 49 should permit at least 25% more air flow through first portion 49 than the same pressure drop across the diffuser board produces in the other portions of diffuser board 28, assuming that the entire diffuser board carries the same depth of fluidizable material. Thus, the same pressure drop across the first portion of the diffuser board as the rest of the diffuser board, produces at least 25% more gas flow through first portion 49 of diffuser board 28 as through the rest of the diffuser board.

In general, as noted above, the amount of air flow at which slugging occurs is greater than the air flow required to fluidize the fluidizable material. Because the air tends to move toward the path of least resistance, this greater localized air flow through a localized mass 50 (FIG. 1) attracts additional air flow from adjacent regions within the mass of fluidizable material. Thus, the relatively greater air flow through the first portion 49 of the diffuser board 28, creates a relatively greater void space in the localized fluidizable mass 50 of material disposed above the first portion 49 of the diffuser board. As shown schematically in FIG. 1, the greater void space results in large slugs 48 of air reaching the patient support surface 55, which is the interface between the cover sheet 44 and the mass of fluidizable material and air supporting the body 45 of the patient. As schematically shown in FIG. 1, in addition to the normal fluidization of the mass of fluidizable material, a percussive fluidization is superimposed on the local portion 50 of the mass of fluidizable material disposed above the first portion 49 of the diffuser board. The effect of this superimposed percussive fluidization on the patient support surface is percussion of the patient support surface and the resultant percussion of anything, such as the back of a patient, which is supported by and in contact with the support surface 55.

In a first alternative embodiment of the percussive fluidization superimposing means, the diffuser board is uniformly resistant to the passage of gas transversely through the board 28. For example, the board's thickness is uniform and the board's porosity is uniform. However, this first alternative embodiment of the percussive fluidization superimposing means can include a means for augmenting the flow of air into the first portion of the plenum to introduce an extra charge of gas from the blower into the first portion of the plenum. As schematically shown in FIG. 1, this embodiment of the percussive fluidization superimposing means can include a separate variable flow valve that is configured and disposed for controlling the flow of air through each one of the plenum inlet pipes. As shown schematically in FIG. 1, each inlet pipe 41, 42, 43 can be provided respectively with a variable flow valve 51, 52, 53. Each separate variable flow valve 51, 52, 53 can be controlled by a controller 46 such as a microprocessor or other controller to regulate the flow of air through that respective inlet pipe 41, 42, 43, and this is schematically indicated in FIG. 1 by the chain-dashed line extending between controller 46 and each motor (schematically indicated by the circle on the stem) of each variable flow valve 51, 52, 53.

The blower and each variable flow valve 51, 52, 53 are operated to provide a sufficiently greater amount of air flow through the first portion 49 of the diffuser board so as to introduce a commensurately greater amount of air flow into the localized mass 50 of fluidizable material disposed above the second plenum chamber 36. At the same time, the variable flow valves 51, 52, 53 for the plenum inlet pipes 41, 42, 43 desirably are controlled so as to maintain sufficient gas velocity to fluidize the fluidizable material above the other portions of the diffuser board. Desirably, the amount of air flow introduced into the localized mass 50 of fluidizable material disposed above the second plenum chamber 36 via the first portion 49 of diffuser board 28 should be within the range of air flows at which the slugging phenomenon occurs within the localized mass 50 of fluidizable material.

In a second alternative embodiment of the percussive fluidization superimposing means, the diffuser board is uniformly resistant to the passage of gas transversely through the board 28. However, this second alternative embodiment of the percussive fluidization superimposing means can include a means for intermittently connecting the outlet 29 of the blower 32 into communication with the first portion of the plenum to introduce an extra charge of gas from the blower into the first portion of the plenum. As shown in FIG. 1 for example, this first portion of plenum 30 can correspond to second plenum chamber 36. These additional charges of gas are sufficient to increase the gas velocity through first portion 49 of diffuser board 28 so that slugging results in the localized mass 50 of fluidizable material above plenum chamber 36 forming the first portion of plenum 30.

As embodied herein and shown schematically in FIG. 1 for example, the intermittent outlet connecting means can include a shuttle valve 56 disposed in communication with the first portion of plenum 30 (in this case, second chamber 36) and with outlet 29 of blower 32 via a pulsation pipe 58, which is connected in communication with a second branch 57 of blower outlet manifold pipe 33. As shown schematically in FIG. 1 for example, shuttle valve 56 desirably is disposed intermediate along the route of communication between the first portion of plenum 30 and outlet 29 of blower 32. As schematically shown in FIG. 1, a separate variable flow valve 59 that is configured and disposed for controlling the flow of air through pulsation pipe 58 and into the first portion of the plenum (in this case, second chamber 36), also can be provided. Variable flow valve 59 can be automatically controlled by a controller 46 such as a microprocessor or other control means, and this is schematically indicated in FIG. 1 by the chain-dashed line extending between controller 46 and the motor (schematically indicated by the circle on the stem) of variable flow valve 59.

Figure 2:
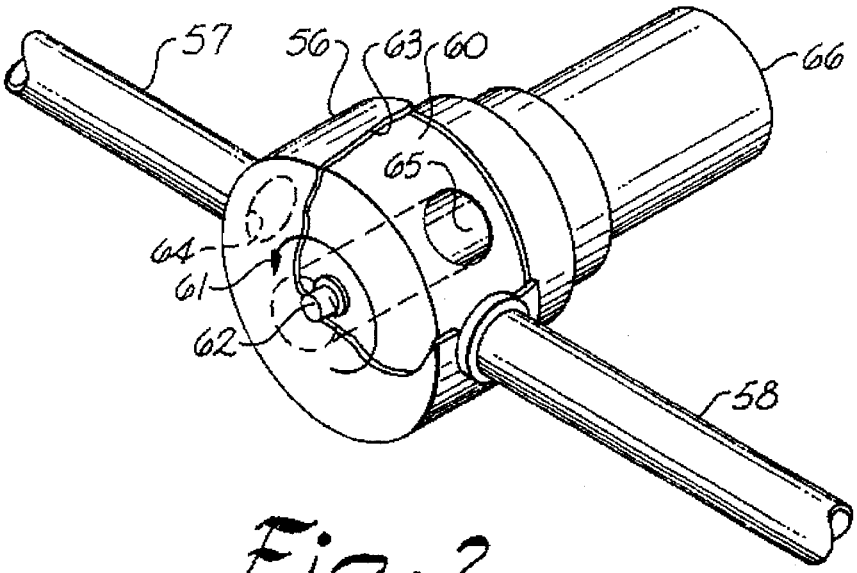
FIG. 2 is an elevated perspective view with portions cut away and portions shown in phantom (dashed line) of preferred embodiments of components of a preferred embodiment of the present invention.

As schematically shown in FIG. 2 for example, shuttle valve 56 can include a piston 60 which is rotatable in the direction of the arrow 61 and rotatably supported about a pivot axis 62 and within a cylindrical housing 63 having a pair of openings 64 disposed radially through housing 63, only one opening 64 being denoted as visible in the view shown in FIG. 2. One housing opening 64 is connected to an air inlet tube such as second branch 57 of blower outlet manifold pipe 33. The oppositely disposed opening 64 is connected to an air outlet tube, such as pulsation pipe 58. The rotatable piston 60 has a diametrically disposed bore 65 formed therethrough. The bore 65 is configured and disposed so that it aligns with the two openings 64 in housing 63 during a portion of rotation of piston 60 in the direction of the arrow 61 shown in FIG. 2. The piston can be rotated by a motor 66 schematically shown in FIG. 2. The motor 66 can be an electrical motor or can be run by the air supply from the blower 32. Shuttle valve 56 can be controlled by a controller 46 such as a microprocessor or other controller to regulate the flow of air through pulsation pipe 58, and this is schematically indicated in FIG. 1 by the chain-dashed line extending between controller 46 and shuttle valve 56. Controller 46 can operate shuttle valve 56 by controlling the operation of motor 66.

This second alternative embodiment of the percussive fluidization superimposing means also can include a separate variable flow valve 51, 52, 53 that is respectively configured and disposed for controlling the flow of air through each one of the plenum inlet pipes 41, 42, 43. Each separate variable flow valve 51, 52, 53 can be controlled by a controller 46 such as a microprocessor or other controller to regulate the flow of air through that respective inlet pipe 41, 42, 43, and this is schematically indicated in FIG. 1 by the chain-dashed line extending between controller 46 and each motor (schematically indicated by the circle on the stem) of each variable flow valve 51, 52, 53. The variable flow valves 51, 52, 53 for the plenum inlet pipes 41, 42, 43, respectively, desirably are controlled so as to maintain sufficient gas velocity to fluidize the fluidizable material above the other portions of the diffuser board 28. However, in some instances, it may be desirable only to provide percussive fluidization under a portion of the patient while supporting the rest of the patient by a nonfluidized mass of material 40, and the controller can be programmed to operate the variable flow valves in a manner to achieve this mode of operation. This would involve shutting off the flow of gas through variable flow valves 51 and 52 for example.

The blower 32, shuttle valve 56, and each variable flow valve 34, 51, 52, 53, 59 are operated to provide a sufficiently greater amount of air flow through the region of the diffuser board disposed above the second plenum chamber 36 so as to introduce a commensurately greater amount of air flow into the local mass 50 of fluidizable material 40 disposed above the second plenum chamber. When the blower is operating to supply air to plenum 30, and the variable flow valves 34, 51, 52, 53, 59 are correctly set so that operation of the motor 66 of the shuttle valve 56 results in the intermittent provision of slugs 48 of air into second plenum chamber 36, these slugs of air provide a greater amount of air flow through the first portion 49 of the diffuser board disposed above the second plenum chamber 36. Such greater amount of air flow through the first portion 49 of the diffuser board disposed above the second plenum chamber 36, introduces a commensurately greater amount of air flow into the local mass 50 of fluidizable material disposed above the second plenum chamber 36. Because the air tends to move toward the path of least resistance, this greater localized air flow attracts additional air flow from adjacent regions within the mass of fluidizable material. Thus, the relatively greater air flow through the first portion 49 of the diffuser board 28 disposed above the second chamber 36 of plenum 30, creates a relatively greater void space in the local fluidizable mass 50 of material disposed above the second chamber. As shown schematically in FIG. 1, the greater void space results in large slugs of air 48 reaching the patient support surface 55. As schematically shown in FIG. 1, in addition to the normal fluidization of the mass of fluidizable material, a percussive fluidization is superimposed on the local portion 50 of the mass of fluidizable material disposed above the first portion 49 of the diffuser board. The effect of this superimposed percussive fluidization on the patient support surface 55 is percussion of the support surface 55 and the resultant percussion of anything, such as the back of a patient, which is supported by and in contact with the support surface 55.

It is believed that the quality of fluidization can be influenced by the type of gas distributor. It is believed that when the gas is distributed into the mass of fluidizable material 40 via a large number of uniformly spaced gas openings, the quality of fluidization of the material 40 is uniform. On the other hand, when the gas is distributed into the mass of fluidizable material via a small number of gas openings, the quality of fluidization of the material 40 becomes less uniform and the slugging phenomenon begins at almost all gas flow rates and becomes severe at high gas flow rates.

Figure 3:
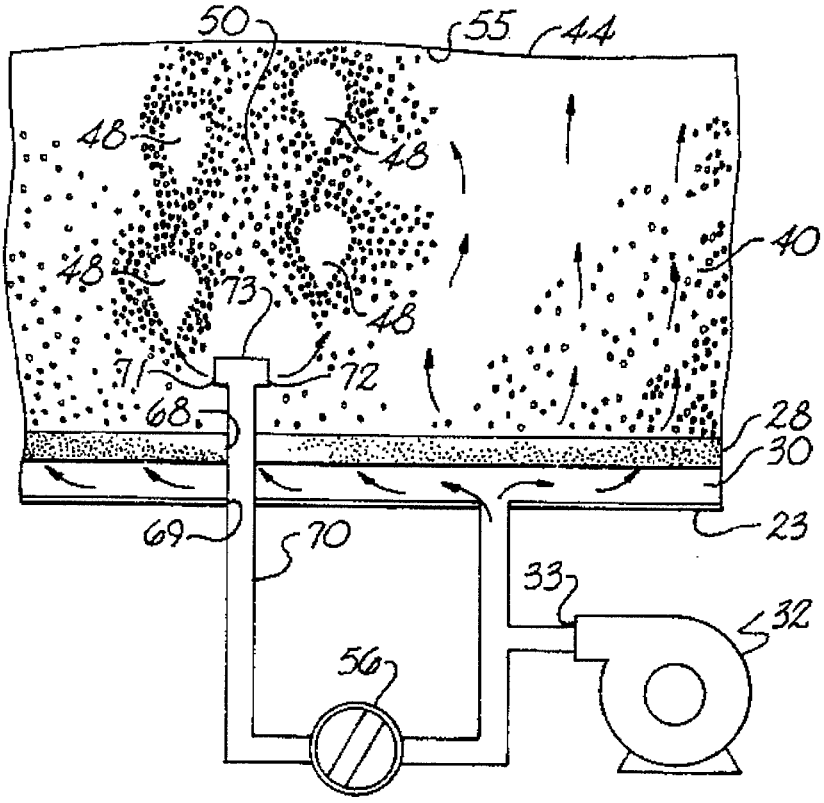
FIG. 3 is a schematic representation of a partial cross-sectional view of an alternative preferred embodiment of the present invention.

As schematically shown in FIG. 3, a third alternative embodiment of the percussive fluidization superimposing means can include at least a first opening 68 disposed through a portion of diffuser board 28. A further alternative embodiment (not shown) of the percussive fluidization superimposing means also can include a second opening disposed through a portion of diffuser board 28. As schematically shown in FIG. 3, a feedthrough opening 69 is provided through a portion of the bottom 23 of tank 22 forming plenum 30. As schematically shown in FIG. 3, feedthrough opening 69 is desirably in registry with the first opening 68 of diffuser board 28. This third alternative embodiment also can include a conduit 70 disposed through feedthrough opening 69 of plenum 30 and through first opening 68 of diffuser board 28. Alternatively, conduit 70 could originate within plenum 30 (not shown) instead of entering through the feedthrough opening 69.

As schematically shown in FIG. 3, conduit 70 desirably has at least one exit opening 71 into the tank disposed above diffuser board 28. This at least one exit opening 71 of conduit 70 is desirably located near diffuser board 28 and closer to diffuser board 28 than to the support surface 55 formed when the beads 40 are fluidized. As shown in FIG. 3, conduit terminates in at least two oppositely disposed exit openings 71, 72 in a "T" fixture 73. A shuttle valve 56 as described above also can be interposed between the outlet 29 of blower 32 and conduit 70 to provide either continuous or intermittent, as desired, air flow into the beads in the local region 50 above "T" structure 73. Blower 30 and shuttle valve 56 can be controlled by a controller 46 as described above and schematically shown in FIG. 1 for example.

Figure 4:
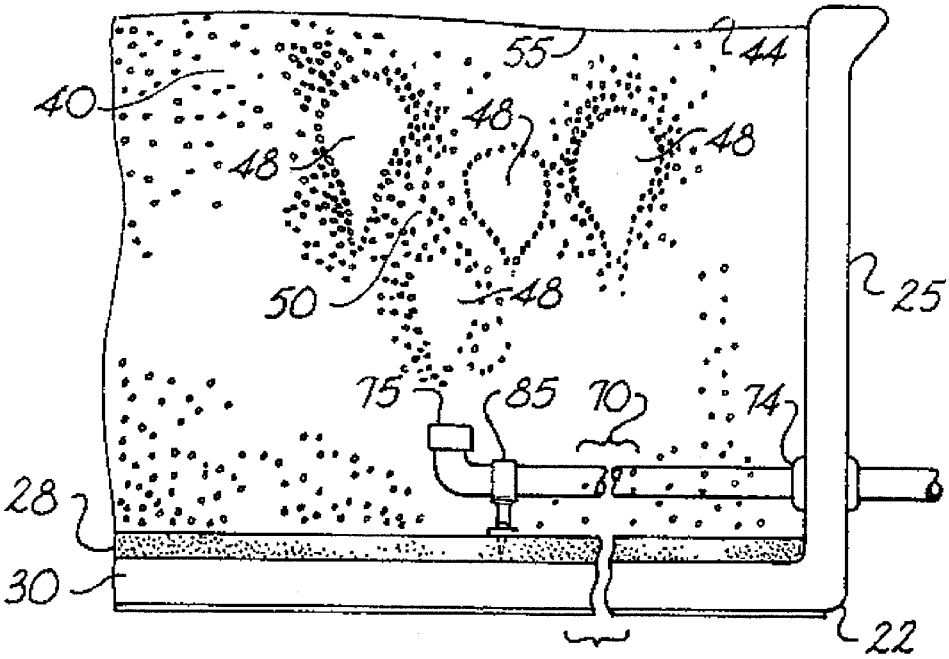
FIG. 4 is a schematic representation of a partial cross-sectional view of a further alternative preferred embodiment of the present invention.

As shown in FIG. 4, in a fourth alternative embodiment of the percussive fluidization superimposing means, a first opening 74 is provided in the side 25 of tank 22 near diffuser board 28, and conduit 70 can enter the tank through first opening 74 and terminate in a bubblecap 75 that allows the air to escape but prevents the fluidizable material from falling into conduit 70 and clogging same. Conventional rubber gaskets 79 secure passage of conduit 70 through first opening 74 through side 25 into tank 22. As shown in FIG. 4, a support bracket 85 may be provided to support conduit 70 above diffuser board 28. Though not depicted in FIG. 4, a shuttle valve 56 as described above and schematically shown in FIG. 3 also can be interposed between the outlet 29 of blower 32 and conduit 70 to provide either continuous or intermittent, as desired, air flow into the beads in the local region 50 above bubblecap 75. Blower 30 and shuttle valve 56 can be controlled by a controller 46 as described above and schematically shown in FIG. 1 for example.

Figure 5:
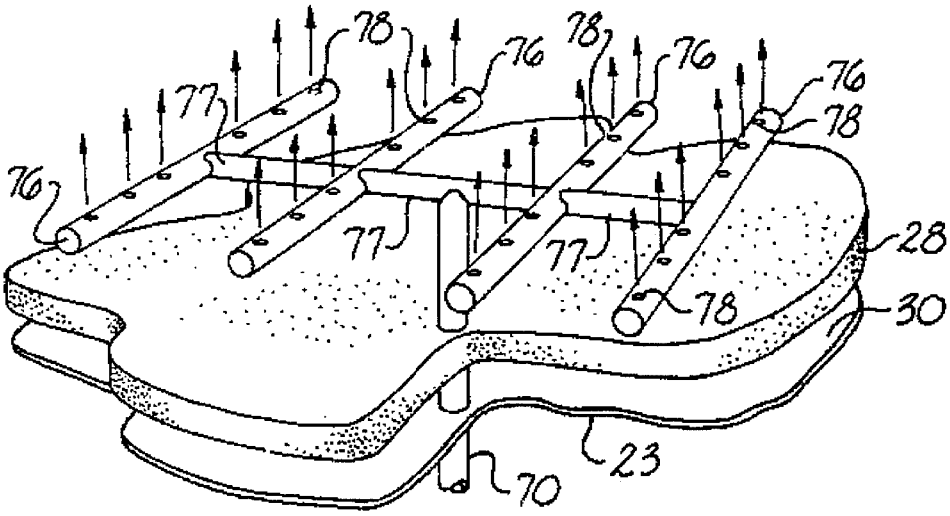
FIG. 5 is an elevated perspective view with portions cut away of a preferred embodiment of a components of an alternative preferred embodiment of the present invention.

In yet a fifth alternative embodiment of the percussive fluidization superimposing means, as shown in FIG. 5 for example, conduit 70 can terminate in an antenna-like structure having a plurality of branches 76 interconnecting with a blind main "T" fixture 77. Conduit 70 can be connected in communication with blower 32. Each branch 76 of blind main "T" fixture 77 has a plurality of exit openings 78 formed in the upper surface of each branch 76. However, in order to shield exit openings 78 from clogging by fluidizable material 40, exit openings 78 desirably could be formed in the bottom surface of each branch 76 or in one or both of the opposite side surfaces of each branch 76. As shown in FIG. 5 for example, a half dozen exit openings 78 are formed in the upper surface of each branch 76 of blind main "T" fixture 77, and four individual branches 76 are provided and disposed near diffuser board 28. Thus, in the embodiment shown in FIG. 5, a plurality of exit openings 78 are provided into the tank at locations closer to diffuser board 28 than to the support surface 55 formed when the beads 40 are fluidized.

As shown in FIG. 5, each of the plurality of exit openings 78 forms part of a symmetrically arranged array of openings into the tank. This fifth alternative embodiment also can include a means for intermittently connecting outlet 29 of blower 32 in communication with the at least one exit opening 78 of conduit 70. Though not depicted in FIG. 5, a shuttle valve 56 as described above and schematically shown in FIG. 3 also can be interposed between the outlet 29 of blower 32 and conduit 70 to provide either continuous or intermittent, as desired, air flow into the beads in the local region 50 above the antenna-like structure having a plurality of branches 76 interconnecting with a blind main "T" fixture 77. Blower 30 and shuttle valve 56 can be controlled by a controller 46 as described above and schematically shown in FIG. 1 for example.

Figure 6:
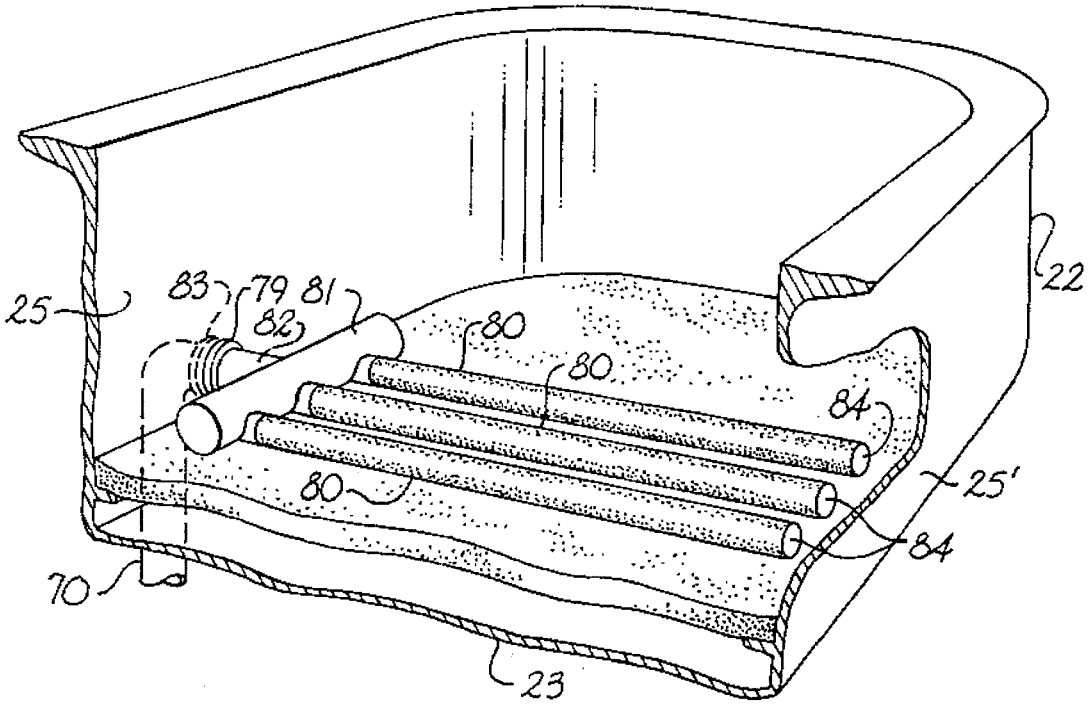
FIG. 6 is a schematic representation of a partial cross-sectional view of yet a further alternative preferred embodiment of the present invention.
Figure 7:
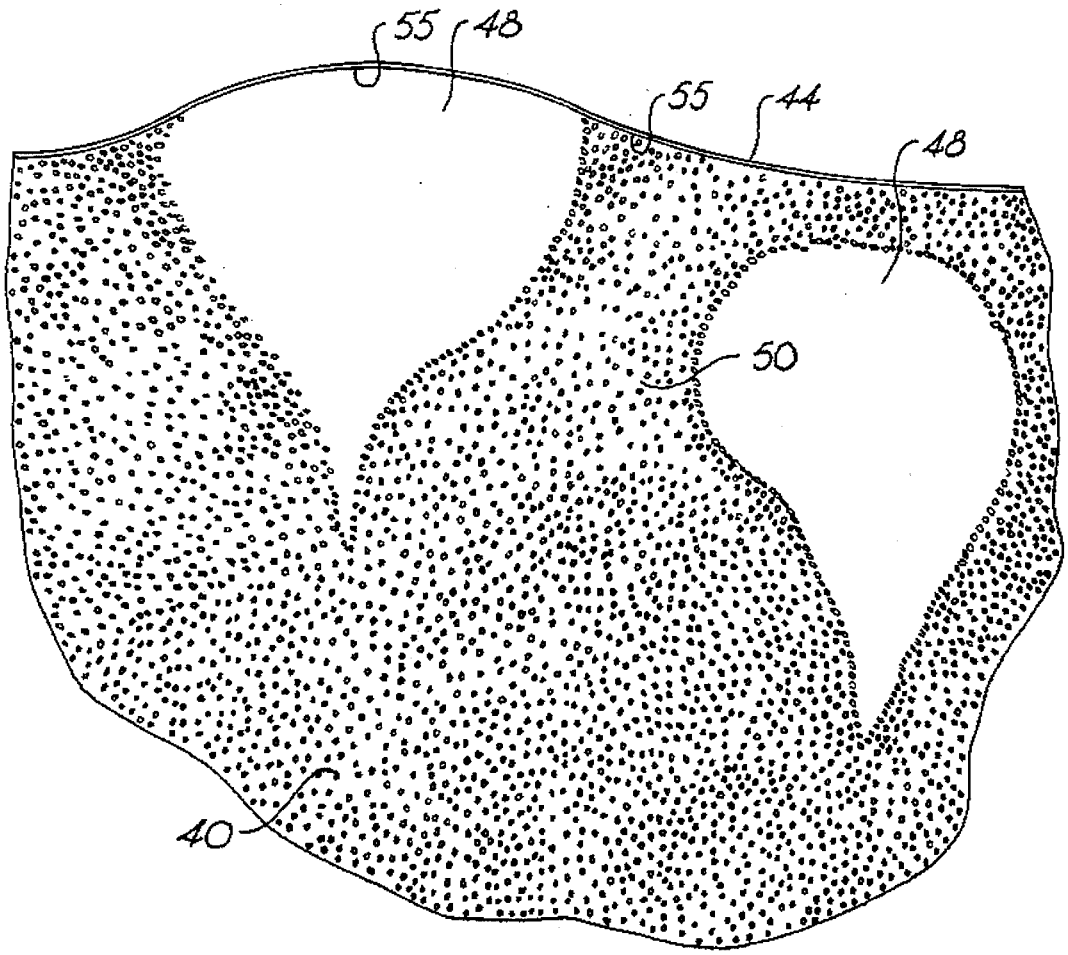
FIG. 7 schematically illustrates the effect of slugs of air at the surface of the patient support surface according to the present invention.

In yet a sixth alternative embodiment of the percussive fluidization superimposing means, as shown in FIG. 6 for example, at least one length of porous tubing 80 can be disposed to extend from one side wall 25 to the opposite side wall 25' near the diffuser board 28 disposed above bottom 23 of tank 22. The number of tubes 80 is determined by the extent of the desired region of percussion at the surface of the fluidizable mass of material. Each porous tube 80 emanates from a manifold 81 which can be connected to a feeder pipe 82 that extends through an opening 83 (dashed line) in side wall 25 of tank 22. Feeder pipe 82 desirably is integral with conduit 70 which is connected in communication with blower 32 (not shown in FIG. 6). Conventional rubber gaskets 79 secure passage of feeder pipe 82 through opening 83 through side wall 25 into tank 22. The blind end 84 of each porous tube 80 can be closed and rests against the inside surface of side wall 25' of tank 22. Though not shown in FIG. 6, a support bracket 85 such as shown in FIG. 4 may be provided to lend additional support to each tube 80 above diffuser board 28. The dots on the three porous tubes 80 are intended to schematically indicate that tubes 80 are porous to the passage of air therethrough. The dots on diffuser board 28 are similarly intended to schematically indicate the porosity of diffuser board 28. Air supply to these tubes 80 is controlled independently from the air supplied to fluidize the bed as a whole. The tubes 80 are disposed in areas where it is desirable to provide the percussive phenomenon. Though not depicted in FIG. 6, a shuttle valve 56 as described above and schematically shown in FIG. 3 also can be interposed between the outlet 29 of blower 32 and conduit 70 to provide either continuous or intermittent, as desired, air flow into the beads in the local region that is disposed above porous tubes 80. Blower 30 and shuttle valve 56 can be controlled by a controller 46 as described above and schematically shown in FIG. 1 for example.

In each of the embodiments of the percussive fluidization superimposing means shown in FIGS. 1–6, the operator is permitted to selectively superimpose percussive fluidization in preselected portions of the patient support surface 55 formed when the beads are fluidized. In several alternative embodiments of the percussive fluidization superimposing means, this can be accomplished by operating the means for intermittently connecting the outlet 29 of the blower 32 to the exit openings of the conduit 70 or to the exit opening of the pulsation pipe 58 and the first portion (chamber 36 for example) of the plenum.

As shown in FIGS. 3–6 for example, the percussive fluidization superimposing means includes at least one means of introducing auxiliary air into the mass of beads, wherein the auxiliary air supplements the fluidizing air that is introduced through the diffuser board. This independent auxiliary air introducing means includes at least one conduit 70, which can be disposed through the bottom 23 of the tank and through the diffuser board 28 as explained above and shown in FIGS. 3 and 5 for example. In an alternative embodiment as shown in FIGS. 4 and 6 for example, the independent auxiliary air introducing means can include at least one conduit 70 disposed through a side 25 of the tank at a location that is closer to the diffuser board 28 than to the support surface 55 formed when the beads are fluidized.

Air takes the path of least resistance. If there is non-uniformity of pressure drop across diffuser board 28, slugs 48 of air will form in locations above less dense regions of the diffuser board. These slugs of air will create a percussive support surface 55, and the patient will experience a localized percussive massaging sensation. The present invention is configured with the capability of introducing this non-uniformity in a selectable fashion so that the non-uniformity can be turned on and off at will.

Any of a variety of different embodiments of fluidized beds can be adapted in accordance with the present invention. Some examples include those beds disclosed in Hargest U.S. Pat. No. 3,428,973; Hargest U.S. Pat. No. 3,866,606; Lacoste U.S. Pat. No. 4,481,686; Paul U.S. Pat. No. 4,483,029; Goodwin U.S. Pat. No. 4,564,965; Goodwin U.S. Pat. No. 4,637,083; Hargest et al U.S. Pat. No. 4,914,760; Hargest et al U.S. Pat. No. 4,942,635; Hargest et al U.S. Pat. No. 4,967,431; Vrzalik U.S. Pat. No. 5,008,965; Hargest et al U.S. Pat. No. 5,029,352; and Hargest U.S. Pat. No. 5,036,559.

What is claimed is:

1. A fluidized bed, comprising:

a tank having a bottom and sides extending upwardly from said bottom and defining an open top at the free end of said sides;

a diffuser board disposed near said tank bottom to define a plenum between said tank bottom, said diffuser board, and a portion of said tank sides disposed near said tank bottom;

a blower having an air outlet connected in communication with said plenum to supply pressurized air to said plenum;

a fluidizable mass of material disposed in said tank and carried by said diffuser board to be fluidized by air supplied from said blower; and a means for superimposing a percussive fluidization in at least one preselected portion of the support surface formed when said mass of material is fluidized.

2. An apparatus as in claim 1, wherein said percussive fluidization superimposing means includes:

a first portion of said plenum separated from the rest of said plenum; and a first portion of said diffuser board disposed over said first portion of said plenum, said first portion of said diffuser board being configured so as to provide less resistance to the flow of air therethrough than the rest of said diffuser board.

3. An apparatus as in claim 2, wherein said first portion of said diffuser board being configured with an average porosity higher than the average porosity of the rest of said diffuser board.

4. An apparatus as in claim 1, wherein said plenum is divided into at least two separate chambers, each said chamber being separated from each other chamber; and said percussive fluidization superimposing means includes a means for intermittently connecting said outlet of said blower in communication with at least one of said separate chambers of said plenum.

5. An apparatus as in claim 4, wherein said intermittent outlet connecting means includes a shuttle valve disposed in communication with said at least one chamber of said plenum and with said outlet of said blower.

6. An apparatus as in claim 1, wherein said percussive fluidization superimposing means includes:

a first portion of said plenum separated from the rest of said plenum;

a first portion of said diffuser board disposed over said first portion of said plenum, said first portion of said diffuser board being formed with an average thickness less than the average thickness of the rest of said diffuser board; and a means for intermittently connecting said outlet of said blower in communication with said first portion of said plenum.

7. An apparatus as in claim 6, wherein said intermittent outlet connecting means includes:

a shuttle valve disposed in communication with said first portion of said plenum and with said outlet of said blower.

8. An apparatus as in claim 1, wherein said percussive fluidization superimposing means includes:

a first opening disposed through a portion of said tank bottom defining a first portion of said plenum;

a second opening disposed through a portion of said diffuser board; and a conduit disposed through said first opening of said plenum and through said second opening of said diffuser board and having at least one exit opening into said tank at a location closer to said diffuser board than to the support surface formed when said mass of material is fluidized.

9. An apparatus as in claim 8, wherein said conduit includes a plurality exit openings into said tank at locations closer to said diffuser board than to the support surface formed when said mass of material is fluidized.

10. An apparatus as in claim 9, wherein each of said plurality of exit openings forms part of a symmetrically arranged array of openings into said tank.

11. An apparatus as in claim 8, further comprising:

a means for intermittently connecting said outlet of said blower in communication with said at least one exit opening of said conduit; and wherein said intermittent outlet connecting means includes a shuttle valve disposed in communication with said first portion of said plenum and with said outlet of said blower.

12. An apparatus as in claim 1, wherein said percussive fluidization superimposing means is configured to permit the operator to selectively superimpose percussive fluidization in preselected portions of the support surface formed when said mass of material is fluidized.

13. An apparatus as in claim 1, wherein said percussive fluidization superimposing means includes at least one means of introducing air into said mass of material independent of air introduced through said diffuser board.

14. An apparatus as in claim 1, wherein said percussive fluidization superimposing means includes at least one conduit disposed through one of said sides of said tank at a location closer to said diffuser board than to the support surface formed when said mass of material is fluidized.

15. An apparatus as in claim 14, wherein said percussive fluidization superimposing means includes at least one bubblecap connected in communication with an end of said conduit disposed inside said tank.

16. An apparatus as in claim 14, wherein said percussive fluidization superimposing means includes at least one porous tube connected in communication with said conduit and configured and disposed to extend from one side of said tank.

17. A method of supporting the body of a patient in a mass of fluidizable material, the method comprising:

fluidizing the mass of fluidizable material beneath at least one preselected portion of the support surface beneath the patient's body sufficient to support the patient's body therein; and superimposing a plurality of percussive pulses of fluidization in addition to the fluidizing of the mass in said at least one preselected portion of the support surface beneath the patient's body.

* * * * *